US007137154B2

(12) United States Patent
Miller et al.

(10) Patent No.: US 7,137,154 B2
(45) Date of Patent: Nov. 21, 2006

(54) APPARATUS FOR LIFTING AND LOWERING TOILET SEATS

(76) Inventors: Stephen H. Miller, 412 12th Ave. South, Naples, FL (US) 34102; Peter J. Takos, P.O. Box 11004, Naples, FL (US) 34101

( * ) Notice: Subject to any disclaimer, the term of this patent is extended or adjusted under 35 U.S.C. 154(b) by 285 days.

(21) Appl. No.: 10/819,694

(22) Filed: Apr. 7, 2004

(65) Prior Publication Data

US 2005/0223480 A1 Oct. 13, 2005

(51) Int. Cl.
*A47K 13/00* (2006.01)

(52) U.S. Cl. ..... 4/234; 4/246.1; 292/101

(58) Field of Classification Search ..... 4/246.1, 4/253, 234, 236; 292/57, 101, 114, 195, 292/196

See application file for complete search history.

(56) References Cited

U.S. PATENT DOCUMENTS 133,370 A * 11/1872 Jennings ..... 4/321 X
167,853 A * 9/1875 Morand ..... 292/57
275,838 A * 4/1883 McLaughlin ..... 4/234
368,717 A * 8/1887 Griswold ..... 4/234
723,973 A * 3/1903 Alexander ..... 4/246.1 X
749,083 A * 1/1904 McElroy ..... 4/234
1,193,148 A * 8/1916 Hornung ..... 292/57

* cited by examiner

*Primary Examiner*—Robert M. Fetsuga

(57) ABSTRACT

Apparatus for facilitating the selective lifting of the lid or the seat/lid combination of a two-piece toilet seat assembly comprises (a) a stem member that is adapted to pass through a pre-formed opening in the lid portion of the seat assembly so as to be movably supported by the lid portion, (b) a manually-engagable handle rigidly connected to one end of the stem member, and (c) a latch member radially-extending from the stem member at a location on axially spaced from the handle. During movement (e.g., rotation) of the stem member within the pre-formed opening in the lid portion, the latch member moves between a seat-latching position in which it underlies a portion of the seat portion of the toilet seat assembly, and a second position in which it is spaced from the seat portion. Thus, applying an axial force on the stem will cause the lid and seat portions to pivot away from the toilet basin together when the latch member is in its seat-latching position, and will cause only the lid portion of the assembly to pivot away from the seat portion when the latch is in its second position.

7 Claims, 7 Drawing Sheets

APPARATUS FOR LIFTING AND LOWERING TOILET SEATS

BACKGROUND OF THE INVENTION

1. Field of the Invention

The present invention relates to improvements in apparatus by which toilet seat assemblies can be manually lifted and lowered to access or cover an underlying toilet bowl or basin. More particularly, it relates to apparatus that is either retrofittable to the lid of a conventional two-piece toilet seat assembly, or is incorporated within the lid portion of a new two-piece toilet seat assembly to enable the user to selectively lift either the lid or the lid/seat combination without physically touching either of the lid or seat components of the assembly 2. Discussion of the Prior Art Conventional two-piece toilet seat assemblies commonly comprise a seat portion and a lid portion. The seat portion is adapted to be mounted atop a toilet basin for pivotal movement about a horizontal axis at the rear of the seat, thus enabling the user to physically lift the seat, i.e., pivot it upwardly, from an operative horizontal position atop the rim of the basin, to a non-operative, generally vertical, position in which the seat is spaced from the rim of the basin. The lid portion of the assembly, in turn, is pivotally mounted on the seat portion of the assembly, and the lid portion typically pivots about the same horizontal axis as that about which the seat portion pivots (or about an axis closely spaced from and parallel to such axis). The lid portion is adapted to be pivoted by the user between an operative position in which it overlies the seat portion of the assembly and covers the toilet basin below, and a non-operative position in which it is sufficiently spaced from the seat portion to allow use of the seat portion. In lifting the lid and/or seat portions of the assembly, it is common for the user to physically contact the bottom surface of either of the lid or seat portions in order to exert an upward force. Unfortunately, this portion of these components is often non-sanitary, making physical contact a health risk.

Various schemes have been proposed heretofore to facilitate the movement of the different toilet seat components by a user in order to avoid physical contact with the seat components. For example, U.S. Pat. No. 5,729,839, issued to R. F. Bigelow, discloses a system in which a pair of U-shaped handles is used to lift each component of a two piece seat assembly. One handle extends radially outward from the bottom of the seat portion of the assembly, and the other handle extends radially outward from the bottom of the lid portion. The handles are angularly displaced from each other so that the user may readily grasp one handle or the other. A rotatably mounted, spherically-shaped knob is attached to each handle to facilitate the lifting and pivotal movement of either component. While such a device is infallible in its operation, its appearance is aesthetically unattractive. Other types of seat handles for lifting one or the other of the seat elements of a two-piece toilet seat assembly are disclosed in U.S. Pat. Nos. 5,459,889 and 5,027,472. Each of the handles disclosed in these patents is relatively complex in construction and/or difficult to access, and some are only useful for raising the seat/lid combination, and not the lid portion alone. Thus, it will be appreciated that a need still exists to provide a relatively simple and low-cost apparatus by which the lid portion or the lid/seat combination of a two-piece toilet seat assembly can be selectively lifted and lowered without the necessity for physically contacting the underside of either component of the seat assembly.

SUMMARY OF THE INVENTION

In view of the foregoing discussion, an object of this invention is to provide a toilet seat lifting device that overcomes the afore-noted disadvantages of the prior art devices.

Another object of this invention is to provide a toilet seat lifting device that can be readily retrofitted to the lid portion of many conventional two-piece toilet seat assemblies.

Still another object of this invention is to provide a new and improved toilet seat lid assembly that incorporates the apparatus of the invention.

In accordance with a first aspect of the invention, a toilet seat-lifting apparatus is provided that is retrofittable in a toilet seat assembly of the type comprising (i) a seat portion that is adapted to be mounted atop a toilet basin for pivotal movement about a horizontal axis to enable the seat portion to be moved between an operative position atop the basin and a non-operative position spaced from the basin, and (ii) a lid portion that is pivotally mounted on the seat portion for movement about the same horizontal axis, whereby the lid is movable between an operative position overlying the seat, and a non-operative position spaced from the seat. The apparatus of the invention comprises (a) a stem member that is adapted to pass through a pre-formed opening in the lid portion so as to be movably supported by the lid portion, (b) a manually-engagable handle rigidly connected to one end of the stem member, such handle being located in a position on one side of the lid portion when the stem member is received by the preformed opening therein, and (c) a latch member radially-extending from the stem member at a location axially spaced from the handle. During movement of the stem member within the pre-formed opening in the lid portion, the latch member moves between a seat-latching first position in which it underlies a portion of the seat portion of the toilet seat assembly, and a second position in which it is spaced from the seat portion. Thus, applying an axial force on the stem will cause both the lid and seat portions to pivot away from the toilet basin together when the latch member is in its seat-latching position, and will cause the lid portion of the assembly to pivot away from the seat portion when the latch is in its second position. Preferably, movement of the latch between its first and second position is effected by rotating the stem member in a preformed circular opening in the lid portion, which movement is caused by appropriately turning the handle. Alternatively, movement of the latch may be effected by a sliding movement of the stem within a slot formed in the lid member.

In accordance with a second aspect of the invention, the lid portion of a two-piece toilet seat assembly embodies a toilet seat-lifting mechanism by which either the lid portion, or a lid/seat combination can be selectively moved away from a toilet basin. The lid portion defines a recess for receiving an activating handle of such mechanism. Preferably, the handle is mounted on the lid portion for pivotal movement between a stored position in which the handle is received within the recess, and an operative position in which the handle can be engaged by the user to move a seat-lifting latch of the mechanism towards and away from a seat-engaging position.

The invention and its advantages will be better understood from the ensuing detailed description of preferred embodiments, reference being made to the accompanying drawings in which like reference characters denote like parts.

DETAILED DESCRIPTION OF PREFERRED EMBODIMENTS

Figure 1A:
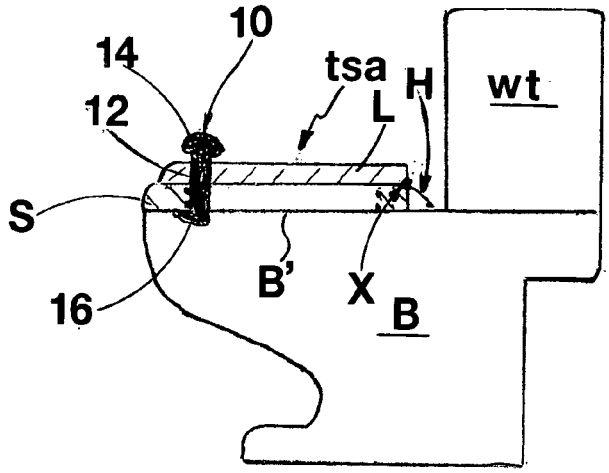
FIGS. 1A–1C are cross-sectional illustrations of a toilet seat assembly embodying the seat-lifting apparatus of the invention.
Figure 1B:
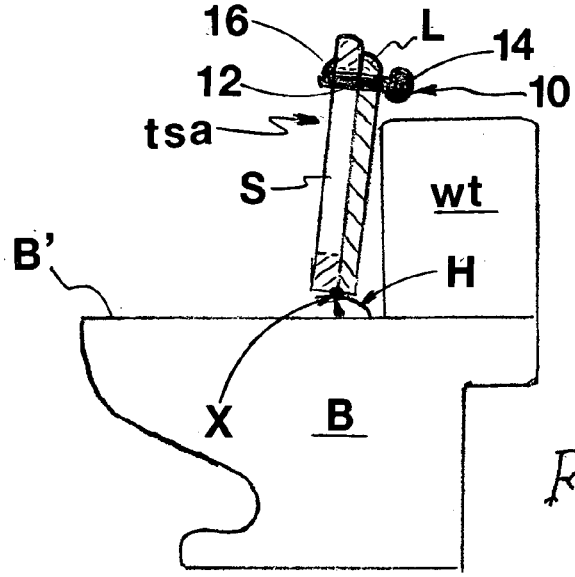
Figure 1C:
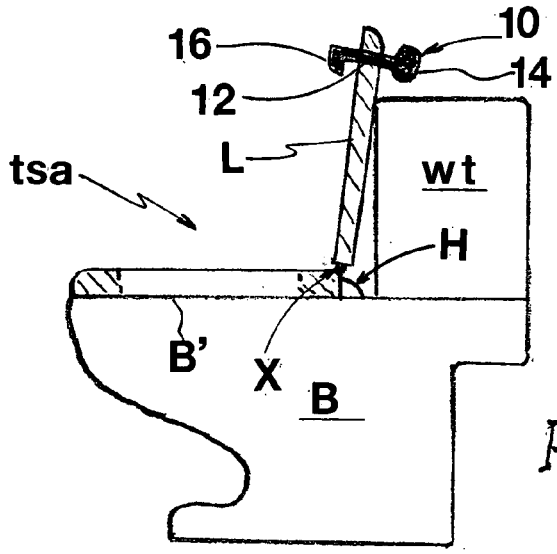

Referring now to the drawings, FIGS. 1A–1C illustrate a conventional two-piece toilet seat assembly tsa positioned atop a standard toilet basin B. Water is selectively supplied to the basin from a standard water tank wt disposed atop the rear portion of the toilet basin. The seat assembly basically comprises a lid portion L, a seat portion S, and, as is standard in most conventional toilet seat assemblies, a housing H by which the seat portion can be movably mounted to the top surface B' of the toilet basin for pivotal movement about a horizontally-extending pivot axis X, and by which the lid portion is pivotally connected to the seat portion for movement about the same axis X. The details of such pivotal mountings are well known and are not any part of this invention. It suffices to say that, in use of the seat assembly, the lid portion can be manually pivoted from an operative, generally horizontal, position in which it overlies the seat portion and the toilet basin, as shown in FIGS. 1A and 1B, to a non-operative, generally vertical, position in which it is spaced from the seat portion, as shown in FIG. 1C. Similarly, the seat portion can be manually pivoted from an operative, generally horizontal, position in which it overlies the rim of the toilet basin, as shown in FIGS. 1A and 1C, to a non-operative, generally vertical, position in which it is spaced from the toilet basin, as shown in FIG. 1B. In conventional seat assemblies of the type described, lifting of the seat portion results in a lifting of the lid portion, but the converse is not true, i.e., the lid may be lifted independently of the seat portion.

Now in accordance with the present invention, lifting of the lid portion L may or may not result in a lifting of the seat portion S. Whether or not the seat portion moves with the lid portion as the latter is pivoted upwardly from its position shown in FIG. 1A is determined by the position of a seat-lifting assembly 10 which, as shown, is movably mounted on the forward part of the lid portion L. Seat-lifting assembly 10 generally comprises a stem 12 that is adapted to pass through a preformed (e.g., drilled) opening provided in the lid portion L, a knob or handle 14 that is rigidly connected to one end of the stem at a location atop the lid portion, and a latching member 16 that extends radially outward from the stem on the opposite side of the lid portion L from the handle. The handle is adapted to be engaged and moved, e.g., rotated about the stem axis A (shown in FIG. 2), by the user to effect a corresponding movement of the stem within the preformed opening, thereby causing the latch member to move from an operative position underlying the bottom of the inside edge of the seat portion, as shown in FIGS. 1A and 1B, to an non-operative position spaced from the seat portion, as shown in FIG. 1C. Thus, when the latch member is moved to its operative, seat-latching position, an upward force on the handle 14 will effect an upward, pivotal movement of the seat/lid combination, towards the position shown in FIG. 1B. When the latching member is moved to its non-operative position, an upward force applied to the handle will result in a movement of only the lid portion, towards the position shown in FIG. 1C. As is apparent from the drawings, pivotal movement of either the lid or the seat/lid combination between the basin-covering and basin-exposing positions can be effected by the apparatus of the invention without the user having to physically contact the non-sanitary underside of either the lid or the seat portions of the toilet seat assembly. Physical contact between the user and the seat assembly is made only by contact with the handle member 14.

Figure 2:
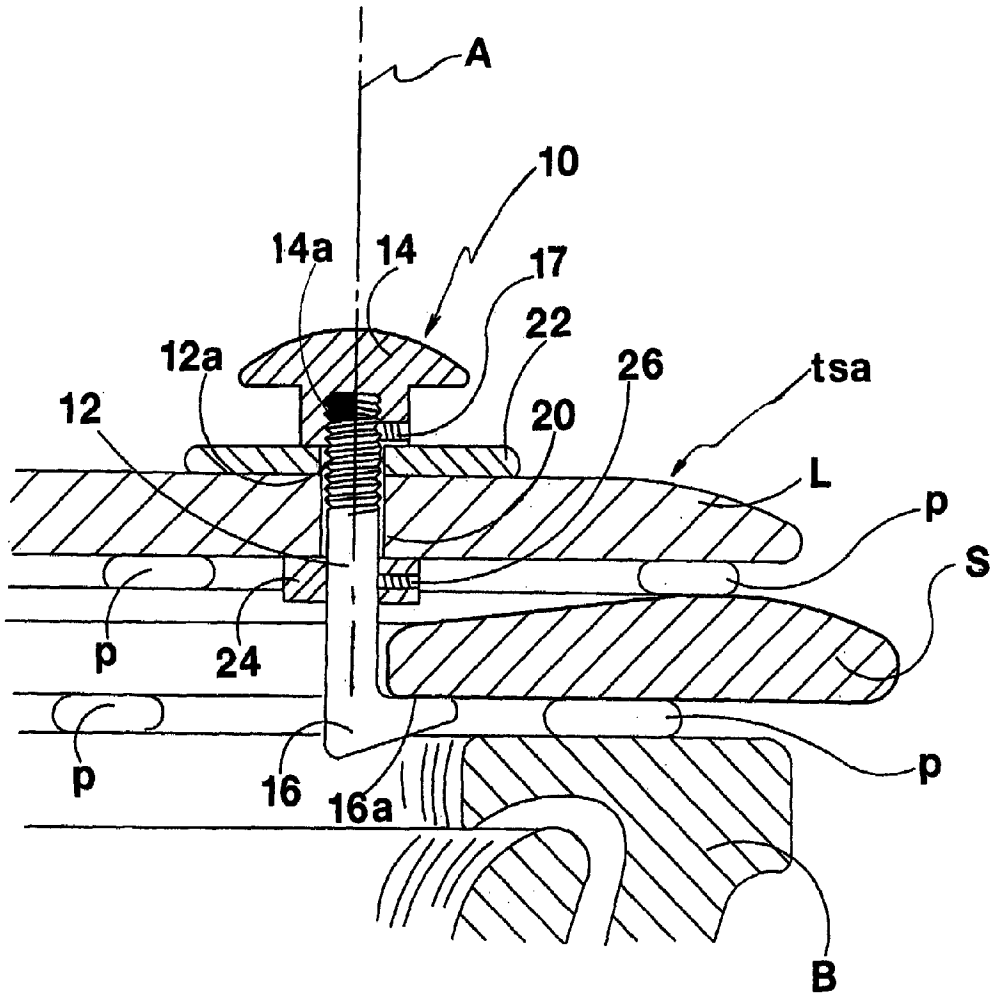
FIG. 2 is a cross-sectional illustration of a portion of a two-piece toilet seat assembly and a preferred embodiment of the invention.
Figure 3:
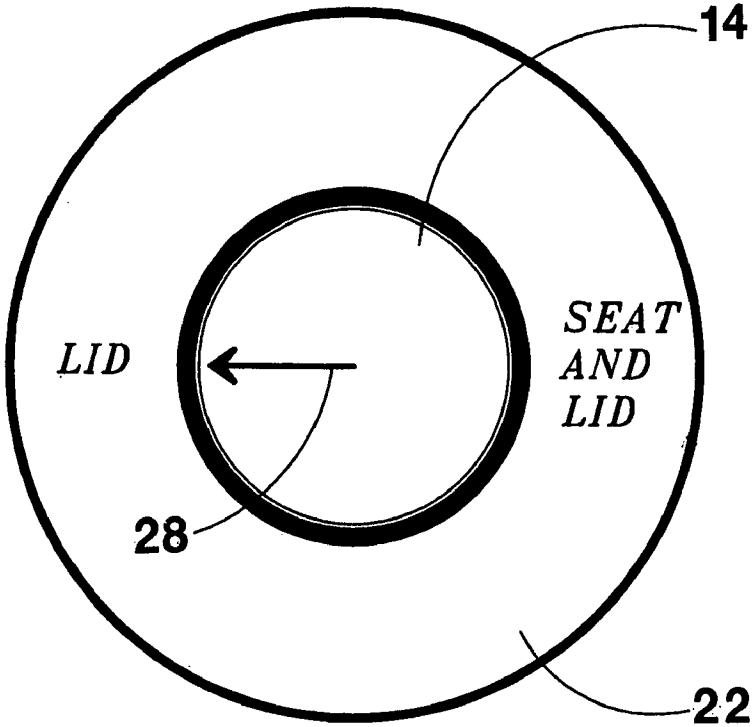
FIG. 3 is a top plan view of a portion of the FIG. 2 apparatus.

In the enlarged illustration of FIG. 2, a preferred embodiment of the seat-lifting apparatus of the invention is shown. The toilet seat assembly tsa is shown as comprising a series of spaced pads P which serve to uniformly separate the bottom of the toilet seat S from the top of the toilet basin, and to space the lid portion L from the top of the toilet seat. Stem 12 of the seat-lifting apparatus is shown to be threaded at one end 12*a* so as to engage a complimentary threaded receptacle formed in the base 14*a* of the handle 14, whereby the axial distance between the handle base and a seat-contacting, flat edge 16*a* of the latch member 16 can be varied to accommodate different thicknesses of the lid/seat combination. A set screw 17 locks the handle to the stem once the desired axial displacement between the handle and latch has been determined. In this embodiment, the stem is rotatably-supported in a circular bore hole 20 formed in the lid member L. The base of handle 14 rests against a strike plate 22, and a collar 24 having a set screw 26 is used to capture the lid portion between the strike plate and collar. In this manner, the seat-lifting apparatus is rotatably mounted on the lid portion. As shown in FIG. 3, the top of the strike plate 22 is provided with diametrically opposing indicia, "LID" and "SEAT AND LID", and the top of handle 14 is provided with an arrow 28 which indicates to the user the direction in which the latch member 16 is oriented. Thus, in lifting the handle, the user is advised whether the lid, or the seat/lid combination is being lifted.

From the foregoing, it will be appreciated that the seat-lifting apparatus described can be readily retrofitted to the lid portion of an existing toilet seat assembly of conventional design. One needs only to modify the lid portion by drilling a suitable bore hole to accommodate the stem 12 of the apparatus. In FIGS. 4–7, however, the apparatus of the invention is shown to be embodied in two different lid portions of a new toilet seat assembly. In the two embodiments shown in these drawings, the handle or knob member 14 is pivotally mounted atop the lid portion so as to be capable of being moved between an operable position, in which it can be engaged and appropriately rotated to effect latching and unlatching of the underlying seat portion, and a storage position in which the handle is received in an appropriately shaped recess formed in the lid member so that the top of the handle is substantially co-planar with the top of the lid.

Figure 4:
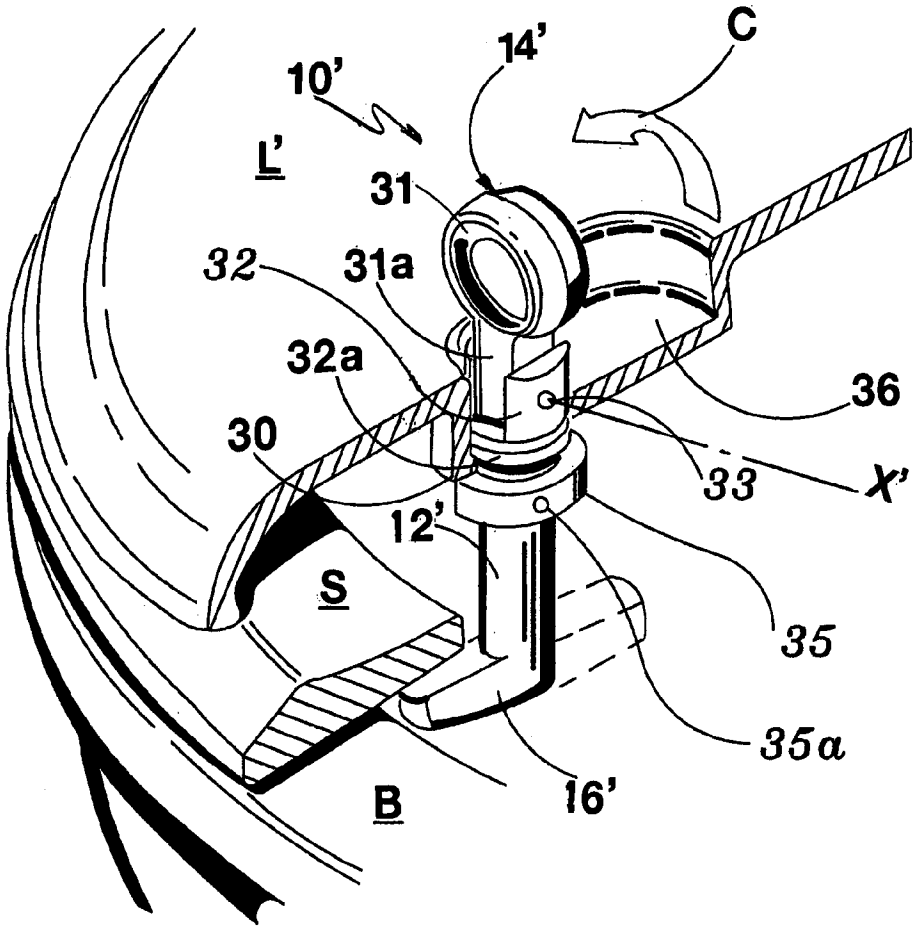
FIGS. 4 and 5 are perspective views of a toilet seat assembly showing, in section, a preferred lid portion incorporating another version of the apparatus of the invention.
Figure 5:
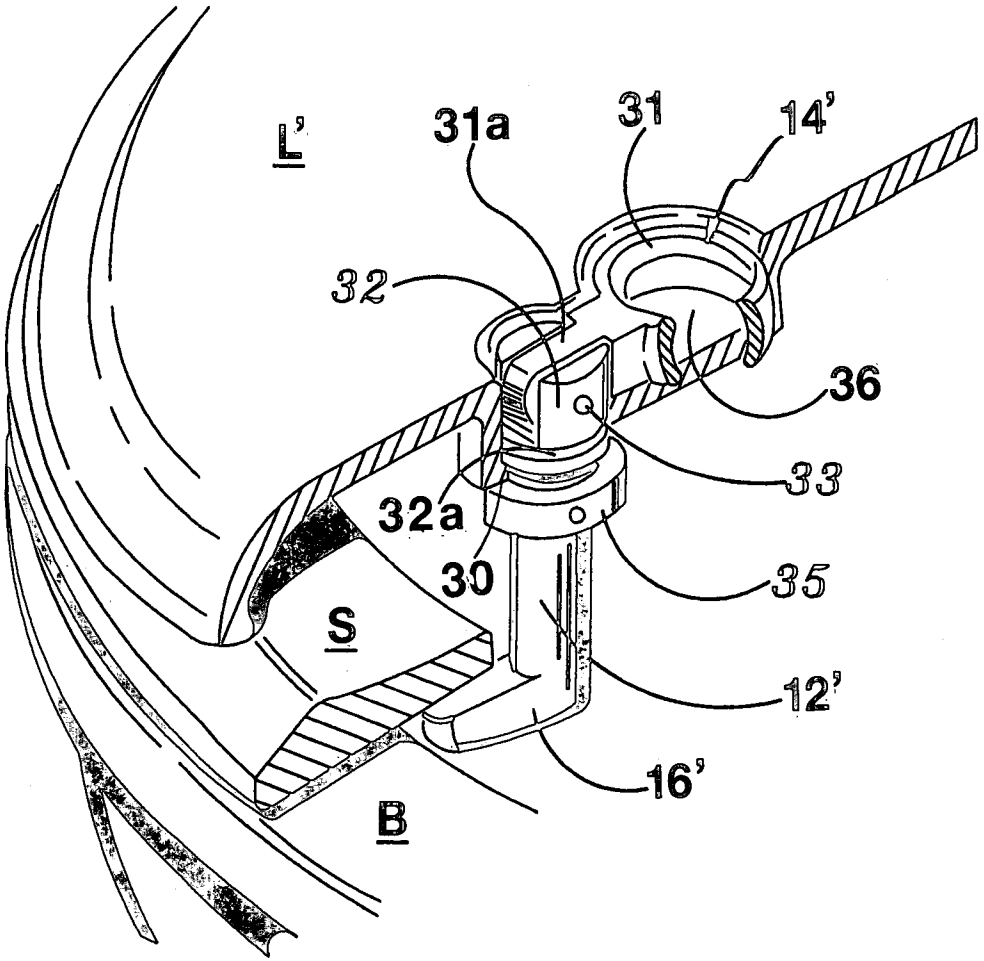

Referring to the embodiment shown in FIGS. 4 and 5, the seat-lifting apparatus 10' comprises a stem 12' that passes through a circular opening 30 formed in a relatively thin toilet seat lid L', a handle member 14' that is adapted to be rigidly coupled to one end of the stem 12', and a latching member 16' radially-extending from the stem at a location axially spaced from the handle. Circular opening 30 is formed at the bottom of a recess 36 adapted to store the handle component of the seat lifting apparatus 10' as explained below. The stem is rotatably supported in the lid opening so as to enable the integral latch member to rotate between the seat-latching position shown in solid lines, and an unlatching position shown in phantom lines. Handle 14' is in the form of a ring 31 having an outwardly extending leg portion 31*a*. Ring 31 is adapted to be engaged and moved by the finger of a user. Leg portion 31*a* is supported for pivotal movement about a horizontal axis X' by a clevis 32 having a pivot pin 33. The base 32*a* of the clevis has a threaded central opening adapted to receive the threaded upper end of the stem 12' which passes through lid opening 30. The stem is retained in opening 30 by a surrounding collar 35 which is snugged up against the bottom of the lid and locked in place on the stem by a set screw 35*a*. Thus, when the handle 14' is pivoted about pivot pin 33 in the direction of arrow C (shown in FIG. 4) to a position in which leg portion 31*a* extends outwardly from the top of the lid, the ring portion 31 may be turned in either direction, about the stem axis A to vary the location of the latching member 16'. When the handle portion is not in use, the handle is pivoted about pin 33 to a storage location in which the ring 31 and leg portion 31*a* are partially enclosed by the recess 36 formed in the lid portion. In such a position, the entire handle assembly is at, or slightly below, the plane of the top side of the lid portion L.

Figure 6:
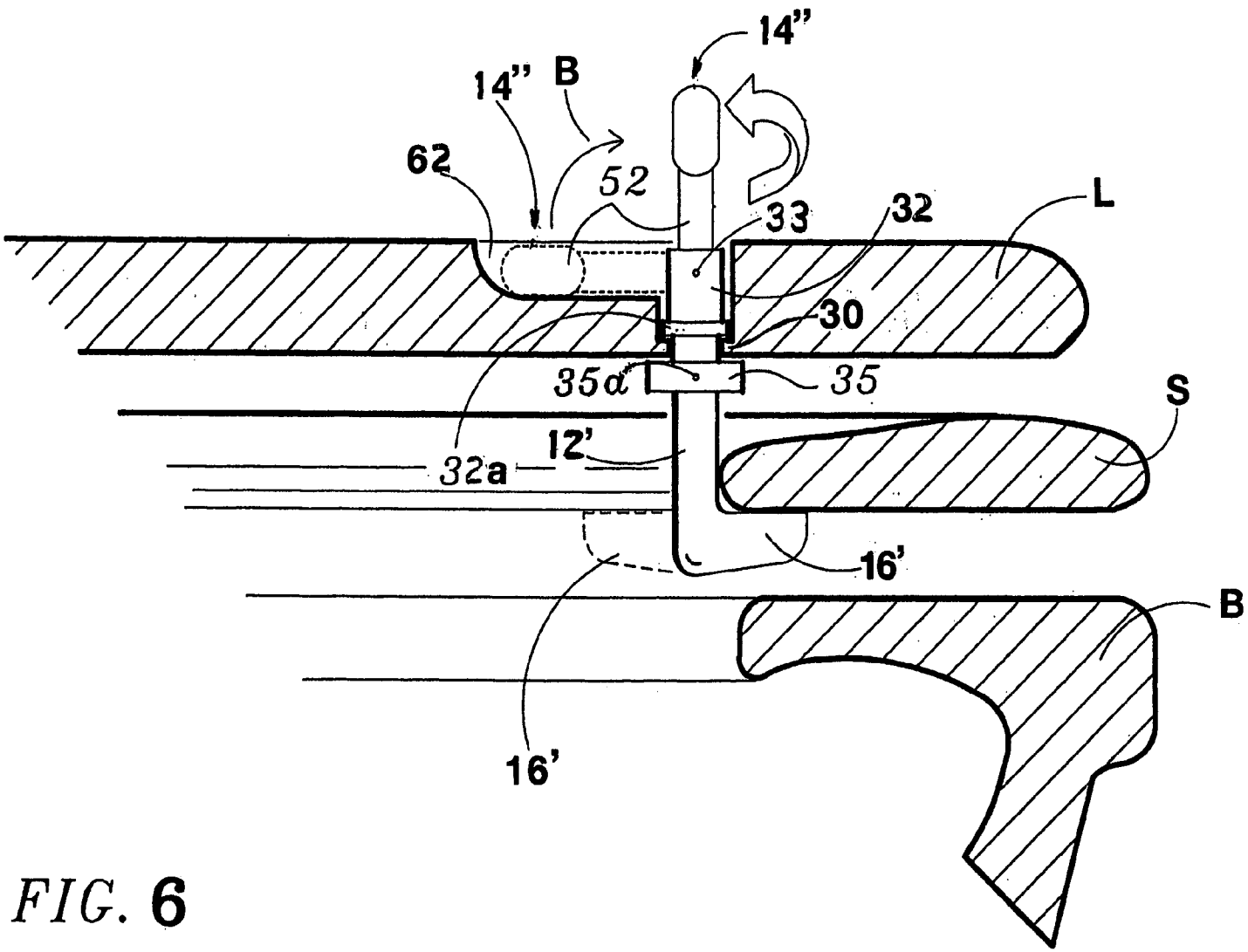
FIG. 6 is a cross-sectional illustration of another embodiment of the invention.
Figure 7:
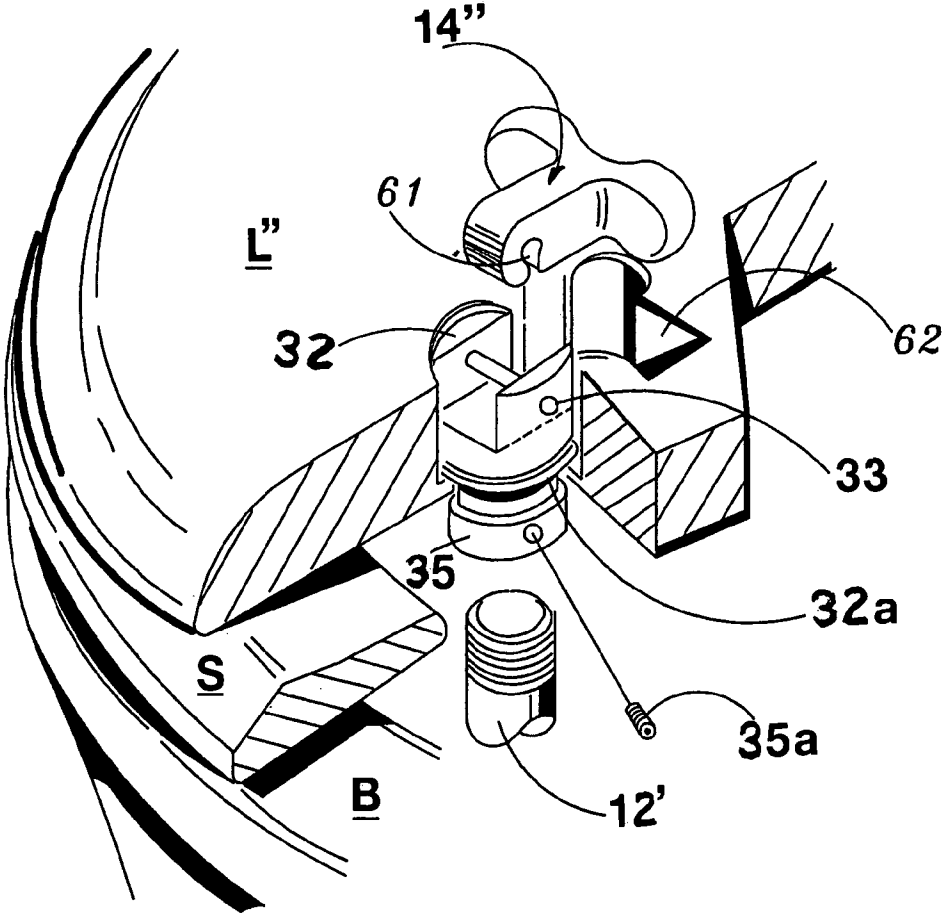
FIG. 7 is an exploded perspective illustration of the apparatus shown in FIG. 6.

In FIGS. 6 and 7, the ring-shaped handle 14' of FIGS. 4 and 5 is replaced by a T-shaped handle 14" which is mounted on the pivot pin 33 of clevis 32 for pivotal movement (as indicated by arrow B) from an operative position, extending outwardly from the lid's upper surface, to a storage position in which the handle is recessed from the lid surface within a T-shaped opening 62 formed in the lid itself. Note, in this embodiment, a conventional toilet seat assembly having a relatively thick lid L" can be retrofitted at the factory to include the recessed opening 62 and the apparatus of the invention. In contrast, the embodiment shown in FIGS. 4 and 5, a new lid design is required. Preferably, the stem portion of handle 14" is provided with a slot 61 to receive the pivot pin 33, whereby the mounting of the handle on the pivot pin is facilitated.

From the foregoing discussion, it will be appreciated that a relatively simple apparatus is provided for dealing with the sanitation problems noted above. It will be appreciated that the embodiments described are exemplary of various devices that can be made without departing from the spirit of the invention. For example, while it is preferred that movement of the latching member is effected by a rotation of the handle 14, it may be seen that such selective latching could be achieved by mounting the stem 12 for sliding movement (within an appropriate slot formed in the lid portion) towards and away from the inside edge of the seat portion. Such a variation, as well as other obvious changes that will become self-evident to skilled artisans as is standard in most conventional toilet seat assemblies, is intended to fall within the scope of the appended claims.

What is claimed is:

1. A toilet seat assembly comprising (i) a seat portion that is adapted to be mounted atop a toilet basin for pivotal movement about a horizontal axis to enable the seat portion to be moved between an operative position atop the basin and a non-operative position spaced from the basin, (ii) a lid portion that is pivotally mounted on the seat portion for movement about the same horizontal axis to enable the lid to be moved between an operative position overlying the seat, and a non-operative position spaced from the seat, and (iii) apparatus for facilitating the manual movement of either said lid portion alone, or said lid and seat portions together, about said horizontal axis, said apparatus comprising:

(a) a stem member adapted to pass through a pre-formed opening in said lid member so as to be movable within said pre-formed opening of said lid portion;

(b) a manually-engagable handle connected to one end of said stem member, said handle being positioned on one side of the lid portion when said stem member has been passed through said preformed opening; and (c) a seat-latching member radially-extending from said stem member at a location axially spaced from said one end of said stem, said seat-latching member being located (i) on the opposite side of said lid member from said handle when said stem member has been passed through said preformed opening and (ii) in a position to selectively engage and retain said seat portion in a fixed relationship with respect to said lid portion when said stem member is manually moved within said preformed opening, in response to a corresponding manual movement of said handle, in a direction to advance said latch member from a first position spaced from said seat portion to a second position engaging said seat portion, whereby the application of an axial force on said stem member while said latch member is in its first position will result in movement of said lid portion only from its operative position towards its non-operative position, and the application of an axial force on said stem member while said latch member is in its second poison will result in movement of both said lid portion and said seat portion from their respective operative positions towards their respective non-operative positions.

2. The apparatus as defined by claim 1 wherein said preformed opening has a circular transverse cross-section, and wherein said stem member is rotatable within said preformed opening to effect movement of said latching member between said first and second positions.

3. The apparatus as defined by claim 1 further comprising means for varying the axial distance between said handle and said seat-latching member.

4. The apparatus as defined by claim 1 wherein said handle is pivotally coupled to said stem member to effect pivotal movement of said handle between an operative position in which said handle can be manually moved to effect movement of said seat-latching member between said first and second positions, and a stored position in which said handle is releasbly stored within a recess formed in said lid member.

5. A toilet seat assembly comprising (i) a seat portion that is adapted to be mounted atop a toilet basin for pivotal movement about a horizontal axis to enable the seat portion to be moved between an operative position atop the basin and a non-operative position spaced from the basin, (ii) a lid portion that is pivotally mounted on the seat portion for movement about the same horizontal axis to enable the lid to be moved between an operative position overlying the seat, and a non-operative position spaced from the seat, and (iii) apparatus for facilitating the manual movement of either said lid portion alone, or said lid and seat portions together, about said horizontal axis, said apparatus comprising:

(a) a stem member adapted to pass through a pre-formed opening in said lid member so as to be movable within said preformed opening of said lid portion;

(b) a manually-engagable handle pivotally coupled to one end of said stem member, said handle being positioned on one side of an upper surface of said lid portion when said stem member has been passed through said pre-formed opening, said handle being pivotal between an operative position in which said handle can be manually moved within said preformed opening, and a stored position in which said handle is releasably stored within a recess formed in said lid member; and (c) a seat-latching member radially-extending from said stem member at a location axially spaced from said one end of said stem, said seat-latching member being located (i) on the opposite side of said lid member from said handle when said stem member has been passed through said preformed opening and (ii) in a position to selectively engage and retain said seat portion in a fixed relationship with respect to said lid portion when said stem member is manually moved within said preformed opening, in response to a corresponding manual movement of said handle, in a direction to advance said latch member from a first position spaced from said seat portion to a second position engaging said seat portion, whereby the application of an axial force on said stem member while said latch member is in its first position will result in movement of said lid portion only from its operative position towards its non-operative position, and the application of an axial force on said stem member while said latch member is in its second poison will result in movement of both said lid portion and said seat portion from their respective operative positions towards their respective non-operative positions.

6. The apparatus as defined by claim 5 wherein said preformed opening has a circular transverse cross-section, and wherein said stem member is rotatable within said preformed opening to effect movement of said latching member between said first and second positions.

7. The apparatus as defined by claim 5 further comprising means for varying the axial distance between said handle and said seat-latching member to accommodate different thicknesses of the lid/seat combination.

* * * * *